US011676619B2

(12) United States Patent
Nakatani et al.

(10) Patent No.: US 11,676,619 B2
(45) Date of Patent: Jun. 13, 2023

(54) NOISE SPATIAL COVARIANCE MATRIX ESTIMATION APPARATUS, NOISE SPATIAL COVARIANCE MATRIX ESTIMATION METHOD, AND PROGRAM

(71) Applicant: NIPPON TELEGRAPH AND TELEPHONE CORPORATION, Tokyo (JP)

(72) Inventors: Tomohiro Nakatani, Tokyo (JP); Marc Delcroix, Tokyo (JP); Keisuke Kinoshita, Tokyo (JP); Shoko Araki, Tokyo (JP); Yuki Kubo, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 40 days.

(21) Appl. No.: 17/437,701

(22) PCT Filed: Feb. 28, 2020

(86) PCT No.: PCT/JP2020/008216

§ 371 (c)(1),
(2) Date: Sep. 9, 2021

(87) PCT Pub. No.: WO2020/184210

PCT Pub. Date: Sep. 17, 2020

(65) Prior Publication Data

US 2022/0130406 A1 Apr. 28, 2022

(30) Foreign Application Priority Data

Mar. 13, 2019 (JP) ..... JP2019-045649

(51) Int. Cl.

| | |
|---|---|
| ***G10L 21/0232*** | (2013.01) |
| ***G10K 11/175*** | (2006.01) |
| ***G10L 21/028*** | (2013.01) |

(52) U.S. Cl.
CPC ..... *G10L 21/0232* (2013.01); *G10K 11/1752* (2020.05); *G10L 21/028* (2013.01)

(58) Field of Classification Search
CPC ..... G10L 21/0232; G10L 21/028; G10L 21/0216; G10L 21/0208; G10L 21/0272;
(Continued)

(56) References Cited

PUBLICATIONS

Higuchi et al. "Online MVDR Beamformer Based on Complex Gaussian Mixture Model With Spatial Prior for Noise Robust ASR", IEEE/ACM Transactions of Audio, Speech, and Language Processing, vol. 25, No. 4, pp. 780-793, April (Year: 2017).*

(Continued)

*Primary Examiner* — Leshui Zhang

(57) ABSTRACT

A time-variant noise spatial covariance matrix is estimated effectively. Using time-frequency-divided observation signals based on observation signals acquired by collecting acoustic signals emitted from one or a plurality of sound sources and mask information expressing the occupancy probability of a component of each of the time-frequency-divided observation signals that corresponds to each noise source, a time-independent first noise spatial covariance matrix corresponding to the time-frequency-divided observation signals and the mask information belonging to a long time interval is acquired for each noise source. Further, using the mask information of each of a plurality of different short time intervals, a mixture weight corresponding to each noise source in each short time interval is acquired. Furthermore, a time-variant third noise spatial covariance matrix is acquired, the third noise spatial covariance matrix being based on a time-variant second noise spatial covariance matrix, which corresponds to the time-frequency-divided observation signals and the mask information belonging to each short time interval and relates to noise formed by adding together all of the noise sources, and a weighted sum (Continued)

of the first noise spatial covariance matrices with the mixture weights of the respective short time intervals.

5 Claims, 3 Drawing Sheets

(58) Field of Classification Search
CPC ..... G10L 19/008; G10L 2021/02166; G10K 11/1752; G10K 11/175; H04R 3/00; H04R 3/005; G01S 3/74; G01S 3/8006; H04B 7/086
See application file for complete search history.

(56) References Cited

PUBLICATIONS

Togami, "Simultaneous Optimization of Forgetting Factor and Time-Frequency Mask for Block Online Multi-Channel Speech Enhancement", ICASSP 2019—2019 IEEE International Conference on Acoustics, Speech and Signal Processing (ICASSP), pp. 2702-2706, May (Year: 2019).*
Kubo et al., Mask-based MVDR beamformer for noisy multisource environments: Introduction of time-varing spatial covariance model, 2019 IEEE Internaional Conference on Acoustics, Speech and signal Processing, Apr. 16, 2019. p. 6855-6859, ISSN 2379-190X.
Higuchi et al. "Robust MVDR beam forming using time-frequency masks for online/offline ASR in noise", Proc. ICASSP 2016.

* cited by examiner

NOISE SPATIAL COVARIANCE MATRIX ESTIMATION APPARATUS, NOISE SPATIAL COVARIANCE MATRIX ESTIMATION METHOD, AND PROGRAM

CROSS-REFERENCE TO RELATED APPLICATIONS

This application is a U.S. 371 Application of International Patent Application No. PCT/JP2020/008216, filed on 28 Feb. 2020, which application claims priority to and the benefit of JP Application No. 2019-045649, filed on 13 Mar. 2019, the disclosures of which are hereby incorporated herein by reference in their entireties.

TECHNICAL FIELD

The present invention relates to a technique for generating a noise spatial covariance matrix.

BACKGROUND ART

A noise spatial covariance matrix is often used to analyze an acoustic signal. NPL 1, for example, discloses a technique for suppressing noise from an observation signal in the frequency domain using a noise spatial covariance matrix. In this method, a beamformer for minimizing the power of noise in the frequency domain is estimated using a noise spatial covariance matrix acquired from an observation signal in the frequency domain and a steering vector representing a sound source direction or an estimated vector thereof under the constraint condition that sound arriving at a microphone from the sound source is not distorted, and noise is suppressed by applying the beamformer to the observation signal in the frequency domain.

CITATION LIST

Non Patent Literature

[NPL 1] T Higuchi, N Ito, T Yoshioka, T Nakatani, "Robust MVDR beamforming using time-frequency masks for online/offline ASR in noise", Proc. ICASSP 2016, 2016.

SUMMARY OF THE INVENTION

Technical Problem

In conventional methods such as that of NPL 1, the noise spatial covariance matrix is estimated using the entirety of an acoustic signal input over a long time interval as a subject. Then, when a beamformer is estimated in each time block, the noise spatial covariance matrix determined for the entire input signal is used. In other words, the beamformer is estimated for each time block on the basis of a common noise spatial covariance matrix.

In an actual environment, noise to be suppressed may include signals such as a voice signal, in which the sound level varies greatly from moment to moment, and in this case, the noise spatial covariance matrix may differ in each time block. It is therefore desirable to estimate a time-variant noise spatial covariance matrix for each time block. As a simple method, a noise spatial covariance matrix may be estimated for each time block using only the acoustic signal of each time block as a subject, but with this method, the time interval of the acoustic signal used for estimation shortens, leading to a reduction in the precision of the noise spatial covariance matrix.

In consideration of this problem, an object of the present invention is to provide a technique for effectively estimating a time-variant noise spatial covariance matrix.

Means for Solving the Problem

Hereafter, in the present invention, time-frequency signals acquired by dividing an acoustic signal into discrete time points (time frames) and discrete frequencies (frequency bands) are used. An observation signal expressed as a time-frequency signal will be referred to as a time-frequency-divided observation signal, for example.

In the present invention, using time-frequency-divided observation signals based on observation signals acquired by collecting acoustic signals emitted from one or a plurality of sound sources and mask information expressing the occupancy probability of a component of each of the time-frequency-divided observation signals that corresponds to each noise source, a time-independent first noise spatial covariance matrix corresponding to the time-frequency-divided observation signals and the mask information belonging to a long time interval is acquired for each noise source. Further, using the mask information of each of a plurality of different short time intervals, a mixture weight corresponding to each noise source in each short time interval is acquired. Furthermore, a time-variant third noise spatial covariance matrix is acquired, the third noise spatial covariance matrix being based on a time-variant second noise spatial covariance matrix, which corresponds to the time-frequency-divided observation signals and the mask information belonging to each short time interval and relates to noise formed by adding together all of the noise sources, and a weighted sum of the first noise spatial covariance matrices with the mixture weights of the respective short time intervals.

Effects of the Invention

The third noise spatial covariance matrix can respond to variation over the short time intervals on the basis of the respective second noise spatial covariance matrices and mixture weights of the short time intervals, and at the same time, the third noise spatial covariance matrix can be acquired with a high degree of precision on the basis of the first noise spatial covariance matrix of the long time interval. As a result, a time-variant noise spatial covariance matrix can be estimated effectively.

DESCRIPTION OF EMBODIMENTS

Figure 1:
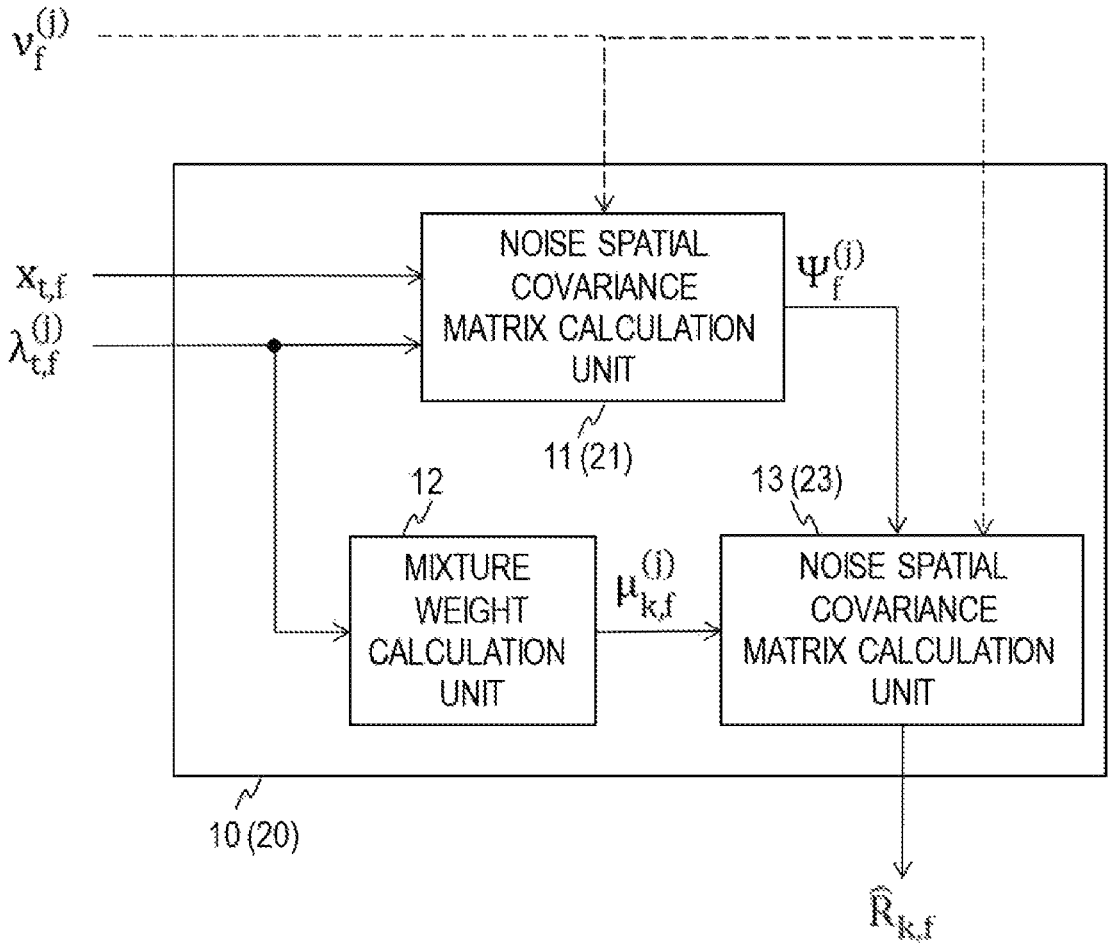
FIG. 1 is a block diagram showing an example of a functional configuration of a noise spatial covariance matrix estimation device according to an embodiment.

Embodiments of the present invention will be described below with reference to the figures.

Definitions of Reference Symbols

First, reference symbols used in the following embodiments will be defined.

I: I is a positive integer expressing the number of microphones. For example, $I \geq 2$.

i: i is a positive integer expressing a microphone number, where $1 \leq i \leq I$ is satisfied.

A microphone having the microphone number i (in other words, an $i^{th}$ microphone) will be written as "microphone i". Values and vectors corresponding to the microphone number i are expressed using reference symbols having the subscript suffix "i".

S: S is a positive integer expressing the number of sound sources. For example, $S \geq 2$. The sound sources include a target sound source and noise sources other than the target sound source.

s: s is a positive integer expressing a sound source number, where $1 \leq s \leq S$ is satisfied. A sound source having the sound source number s (in other words, an $s^{th}$ sound source) will be written as "sound source s".

J: J is a positive integer expressing the number of noise sources. For example, $S \geq J \geq 1$.

j, j': j and j' are positive integers expressing a noise source number, where $1 \leq j, j' \leq J$ is satisfied. A noise source having the noise source number j (in other words, a $j^{th}$ noise source) will be written as "noise source j". Further, the noise source number is expressed using an upper right suffix in round parentheses. Values and vectors based on the noise source having the noise source number j are expressed using reference symbols having the upper right suffix "(j)". This applies likewise to j'. Furthermore, in this specification, a sound acquired by adding together sounds emitted from all of the noise sources is treated as noise.

L: L expresses a long time interval. The long time interval may be the entire time interval subject to processing or a partial time interval of the entire time interval subject to processing.

$B_k$: $B_k$ expresses a single short time interval (a short time block). A plurality of different short time intervals are expressed by $B_1, \ldots, B_K$, where K is an integer of 1 or more and $k=1, \ldots, K$. For example, the short time intervals $B_1, \ldots, B_K$ are acquired by separating the long time interval L into K time intervals. Some or all of the short time intervals $B_1, \ldots, B_K$ may be included in an interval other than the long time interval L.

t, τ: t and τ are positive integers expressing a time frame number. Values and vectors corresponding to the time frame number t are expressed using symbols having the subscript suffix "t". This applies likewise to t.

f: f is a positive integer expressing a frequency band number. Values and vectors corresponding to the frequency band number f are expressed using symbols having the subscript suffix "f".

T: T expresses a non-conjugate transpose of a matrix or a vector. $\alpha^T$ represents a matrix or a vector acquired by implementing non-conjugate transpose on α.

H: H expresses a conjugate transpose (a Hermitian transpose) of a matrix or a vector. $\alpha^H$ represents a matrix or a vector acquired by implementing conjugate transpose on α.

$a \in \beta : \alpha \in \beta$ indicates that α belongs to β.

First Embodiment

Next, referring to FIGS. 1 and 2, the configuration and processing content of a noise spatial covariance matrix estimation device 10 according to a first embodiment will be described.

Figure 2:
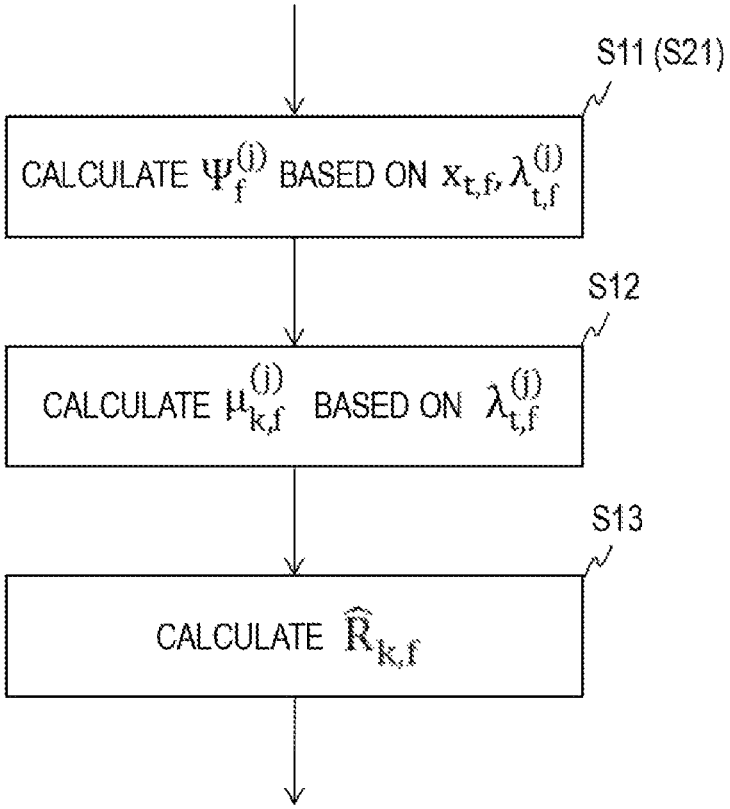
FIG. 2 is a flowchart showing an example of a noise spatial covariance matrix estimation method according to this embodiment.

As shown in FIG. 1, the noise spatial covariance matrix estimation device 10 according to this embodiment includes noise spatial covariance matrix calculation units 11, 13 and a mixture weight calculation unit 12.

<Noise Spatial Covariance Matrix Calculation Unit 11 (First Noise Spatial Covariance Matrix Calculation Unit)>

The noise spatial covariance matrix calculation unit 11 receives, as input, time-frequency-divided observation signals $x_{t,f}$ based on observation signals acquired by collecting acoustic signals emitted from one or a plurality of sound sources $s \in \{1, \ldots, S\}$ and mask information $\lambda_{t,f}^{(j)}$ expressing the occupancy probability of a component of each of the time-frequency-divided observation signals $x_{t,f}$ corresponding to each noise source j, and uses these elements to acquire and output, for each noise source $j \in \{1, \ldots, J\}$, a time-independent noise spatial covariance matrix $\psi_f^{(j)}$ (a first noise spatial covariance matrix) corresponding to the time-frequency-divided observation signals $x_{t,f}$ and the mask information $\lambda_{t,f}^{(j)}$ belonging to the long time interval L (step S11). Note that the noise sources are assumed to include both sounds (point sound sources) generated from a single location, such as voices, and sounds (diffusive noise) arriving from any peripheral direction, such as background noise. Further, the upper right suffix "(j)" of "$\lambda_{t,f}^{(j)}$") should actually be written directly above the lower right suffix "t, f" but due to notation limitations has been written to the upper right of "t, f". This applies likewise to other notation using the upper right suffix "(j)", such as "$\psi_f^{(j)}$".

<<Illustration of Time-Frequency-Divided Observation Signals $x_{t,f}$>>

Acoustic signals emitted from the sound source s are collected by the I microphones $i \in \{1, \ldots, I\}$ (not shown). One sound source $s \in \{1, \ldots, S\}$, for example, is a noise source $j \in \{1, \ldots, J\}$. The collected acoustic signals are converted into digital signals $X_{\tau,1}, \ldots, X_{\tau,I}$ in the time domain, whereupon the time-domain digital signals $X_{\tau,1}, \ldots, X_{\tau,I}$ are converted into the frequency domain in units of a predetermined time interval. An example of conversion into the frequency domain in time interval units is the short-time Fourier transform. For example, signals acquired by conversion into the frequency domain in time interval units may be set as time-frequency-divided observation signals $x_{t,f,1}, \ldots, x_{t,f,I}$, where $x_{t,f} = (x_{t,f,1}, \ldots, x_{t,f,I})^T$. Alternatively, the result of performing arithmetic of some kind on the signals acquired by conversion into the frequency domain in time interval units may be set as $x_{t,f,1}, \ldots, x_{t,f,I}$, where $x_{t,f} = (x_{t,f,1}, \ldots, x_{t,f,I})^T$. In other words, the time-frequency-divided observation signals corresponding to the observation signals acquired by collecting sound in the $i^{th}$ microphone and corresponding to the frequency band f at the time frame t, for example, are $x_{t,f,i}$ ($i \in \{1, \ldots, I\}$), where $x_{t,f} = (x_{t,f,1}, \ldots, x_{t,f,I})^T$. The time-frequency-divided observation signals $x_{t,f}$ (where $t \in L$) belonging at least to the long time interval L are input into the noise spatial covariance matrix calculation unit 11 according to this embodiment. The time-frequency-divided observation signals $x_{t,f}$ belonging to the long time interval L may be input alone, or the time-frequency-divided observation signals $x_{t,f}$ belonging to a time interval that is longer than the long time interval L and includes the long time interval L may be input. There are no limitations on the long time interval L. For example, the entire time interval during which sound is collected may be set as the long time interval L, a voice interval extracted therefrom may be set as the long time interval L, a predetermined time interval may be set as the long time interval L, or a specified time interval may be set as the long time interval L. An example of the long time interval L is a time interval of approximately 1 second to several tens of seconds. The time-frequency-divided observation signals $x_{t,f}$ may be either stored in a storage device not shown in the figures or transmitted over a network.

<<Illustration of Mask Information $\lambda_{t,f}^{(j)}$>>

The mask information $\lambda_{t,f}^{(j)}$ expresses the occupancy probability of a component of each of the time-frequency-divided observation signal $x_{t,f}$ corresponding to each noise source j. In other words, the mask information $\lambda_{t,f}^{(j)}$ expresses the occupancy probabilities of the components of the respective time-frequency-divided observation signals $x_{t,f,1}, \ldots, x_{t,f,I}$ in the frequency band f at the time frame t that correspond to each noise source j. In this embodiment, it is assumed that the mask information $\lambda_{t,f}^{(j)}$ corresponding to each frequency band f and each noise source j is estimated by an external device, not shown in the figures, for at least the time frames $t \in L$ belonging to the long time interval L and the time frames $t \in B_k$ belonging to the short time intervals $B_k$. There are no limitations on the method for estimating the mask information $\lambda_{t,f}^{(j)}$. Methods for estimating the mask information $\lambda_{t,f}^{(j)}$ are well-known, and various methods, for example an estimation method using a complex Gaussian mixture model (CGMM) (reference document 1, for example), an estimation method using a neural network (reference document 2, for example), an estimation method combining these methods (reference document 3, for example), and so on are available.

Reference document 1: T. Higuchi, N. Ito, T. Yoshioka, and T. Nakatani, "Robust MVDR beamforming using time-frequency masks for online/offline ASR in noise", Proc. IEEE ICASSP-2016, pp. 5210-5214, 2016.

Reference document 2: J. Heymann, L. Drude, and R. Haeb-Umbach, "Neural network based spectral mask estimation for acoustic beamforming", Proc. IEEE ICASSP-2016, pp. 196-200, 2016.

Reference document 3: T. Nakatani, N. Ito, T. Higuchi, S. Araki, and K. Kinoshita, "Integratin DNN-based and spatial clustering-based mask estimation for robust MVDR beamforming", Proc. IEEE ICASSP-2017, pp. 286-290, 2017.

The mask information $\lambda_{t,f}^{(j)}$ may be estimated in advance and stored in a storage device, not shown in the figures, or estimated successively.

<<Illustration of Noise Spatial Covariance Matrix $\varphi_f^{(j)}$>>

The noise spatial covariance matrix calculation unit 11 according to this embodiment receives the time-frequency-divided observation signals $x_{t,f}$ and the mask information $\lambda_{t,f}^{(j)}$ as input, and estimates and outputs a time-independent noise spatial covariance matrix $\psi_f^{(j)}$ corresponding to the time-frequency-divided observation signals $x_{t,f}$ and the mask information $\lambda_{t,f}^{(j)}$ belonging to the long time interval L. For example, the noise spatial covariance matrix $\psi_f^{(j)}$ is the sum or the weighted sum of $\lambda_{t,f}^{(j)} \times x_{t,f} \times x_{t,f}^H$ with respect to the frequency band f at the time frames $t \in L$ belonging to the long time interval L. For example, the noise spatial covariance matrix calculation unit 11 calculates (estimates) and outputs the noise spatial covariance matrix $\psi_f^{(j)}$ as shown below in formula (1).

$$\Psi_f^{(j)} = \frac{\nu_f^{(j)} - I}{\sum_{t \in L} \lambda_{t,f}^{(j)}} \sum_{t \in L} \lambda_{t,f}^{(j)} x_{t,f} x_{t,f}^H \tag{1}$$

Here, $\nu_f^{(j)}$ is a real number parameter (a hyperparameter), and in this embodiment, $\nu_f^{(j)}$ is a constant. The significance of $\nu_f^{(j)}$ will be described below.

<Mixture Weight Calculation Unit 12>

The mixture weight calculation unit 12 receives the mask information $\lambda_{t,f}^{(j)}$ of each of the plurality of different short time intervals $B_k$ (where $k \in \{1, \ldots, K\}$) as input, and uses this to acquire and output a mixture weight $\mu_{k,f}^{(j)}$ corresponding to each noise source $j \in \{1, \ldots, J\}$ in each short time interval $B_k$ (step S12). An example of the mixture weight $\mu_{k,f}^{(j)}$ is a ratio of a second sum to a first sum, as will now be described. The first sum is the sum of the mask information $\lambda_{t,f}^{(j')}$ corresponding to the frequency band f at the time frame number t belonging to the respective short time intervals $B_k$ with respect to all of the noise sources $j' \in \{1, \ldots, J\}$. The second sum is the sum of the mask information $\lambda_{t,f}^{(j)}$ corresponding to the frequency band f at the time frame t belonging to the respective short time intervals $B_k$ with respect to each noise source j. For example, the mixture weight calculation unit 12 acquires and outputs the mixture weights $\mu_{k,f}^{(j)}$ as shown below in formula (2).

$$\mu_{k,f}^{(j)} = \frac{\sum_{t \in B_k} \lambda_{t,f}^{(j)}}{\sum_{t \in B_k} \sum_{j' \in \{1,\cdots,J\}} \lambda_{t,f}^{(j')}} \tag{2}$$

<Noise Spatial Covariance Matrix Calculation Unit 13 (Second Noise Spatial Covariance Matrix Calculation Unit)>

The noise spatial covariance matrix calculation unit 13 acquires and outputs a noise spatial covariance matrix to be described below from the following four inputs (step S13). The four inputs are the time-frequency-divided observation signals $x_{t,f}$, the mask information $\lambda_{t,f}^{(j)}$ of each noise source $j \in \{1, \ldots, J\}$, the noise spatial covariance matrix $\psi_f^{(j)}$ of each noise source j, and the mixture weight $\mu_{k,f}^{(j)}$ of each noise source j. The aforementioned noise spatial covariance matrix is a time-variant noise spatial covariance matrix $\hat{R}_{k,f}$ (a third noise spatial covariance matrix) based on a time-variant noise spatial covariance matrix (a second noise spatial covariance matrix) corresponding to the time-frequency-divided observation signals $x_{t,f}$ and the mask information $\lambda_{t,f}^{(j)}$ belonging to each short time interval $B_k$ (where $k \in \{1, \ldots, K\}$) with respect each noise source $n \in \{1, \ldots, J\}$ and a weighted sum of the noise spatial covariance matrices $\psi_f^{(j)}$ (the first noise spatial covariance matrices) with the mixture weights $\mu_{k,f}^{(j)}$ of the respective short time intervals $B_k$. Note that the suffix "^" to the upper right of "R" should actually be written directly above "R" but due to notation limitations has been written to the upper right of "R". For example, the time-variant noise spatial covariance matrix (the second noise spatial covariance matrix) corresponding to the time-frequency-divided observation signals $x_{t,f}$ and the mask information $\lambda_{t,f}^{(j)}$ belonging to each short time interval $B_k$ and the frequency band f with respect to noise formed by adding together all of the noise sources is the sum or the weighted sum of $\lambda_{t,f}^{(j)} \times x_{t,f} \times x_{t,f}^{H}$ at the time frame t and all of the noise sources j belonging to each short time interval $B_k$. Further, the noise spatial covariance matrix $\hat{R}_{k,f}$ (the third noise spatial covariance matrix) is based on a weighted sum of the time-variant noise spatial covariance matrix (the second noise spatial covariance matrix) corresponding to the time-frequency-divided observation signals $x_{t,f}$ and the mask information $\lambda_t$, P belonging to each short time interval $B_k$ and the frequency band f with respect to noise formed by adding together all of the noise sources, and the weighted sum of the noise spatial covariance matrices $\psi_f^{(j)}$ with the mixture weights $\mu_{k,f}^{(j)}$ with respect to all of the noise sources $j \in \{1, \ldots, J\}$. For example, the noise spatial covariance matrix calculation unit 13 calculates (estimates) and outputs the time-variant noise spatial covariance matrix $\hat{R}_{k,f}$ as shown below in formula (3).

$$\hat{R}_{k,f} = \frac{\sum_{t \in B_k} \sum_{j \in \{1,\cdots,J\}} \lambda_{t,f}^{(j)} x_{t,f} x_{t,f}^{H} + \sum_{j \in \{1,\ldots,J\}} \mu_{k,f}^{(j)} \Psi_f^{(j)}}{\sum_{t \in B_k} \sum_{j \in \{1,\cdots,J\}} \lambda_{t,f}^{(j)} + \sum_{j \in \{1,\ldots,J\}} \mu_{k,f}^{(j)} (v_f^{(j)} + 1)} \tag{3}$$

In this example, the noise spatial covariance matrix $\hat{R}_{k,f}$ is the weighted sum of the noise spatial covariance matrix $$\sum_{t \in B_k} \sum_{j \in \{1,\cdots,J\}} \lambda_{t,f}^{(j)} x_{t,f} x_{t,f}^{H}$$

and the weighted sum $$\sum_{j \in \{1,\ldots,J\}} \mu_{k,f}^{(j)} \Psi_f^{(j)}$$

of the noise spatial covariance matrices $\psi_f^{(j)}$ with the mixture weights $\mu_{k,f}^{(j)}$ in each short time interval $B_k$, where the parameter $v_f^{(j)}$ is used to determine the weights of the noise spatial covariance matrix $\psi_f^{(j)}$ and the noise spatial covariance matrix $$\sum_{j \in \{1,\ldots,J\}} \mu_{k,f}^{(j)} \Psi_f^{(j)}$$

in the noise spatial covariance matrix $\hat{R}_{k,f}$.

Note that here, as an example, the noise spatial covariance matrix calculation unit 13 acquires the noise spatial covariance matrix $\hat{R}_{k,f}$ using the time-frequency-divided observation signals $x_{t,f}$, the mask information $\lambda_{t,f}^{(j)}$ of each noise source $j \in \{1, \ldots, J\}$, the noise spatial covariance matrix $\psi_{t,f}$ of each noise source j, and the mixture weight $\mu_{k,f}^{(j)}$ of each noise source j as input, but the present invention is not limited thereto. More specifically, the noise spatial covariance matrix calculation unit 13 may acquire the noise spatial covariance matrix $\hat{R}_{k,f}$ using $\lambda_{t,f}^{(j)} \times x_{t,f} \times x_{t,f}^{H}$, which is acquired midway through the calculations of the noise spatial covariance matrix calculation unit 11, as input instead of the time-frequency-divided observation signals $x_{t,f}$.

Features of this Embodiment

In this embodiment, the time-variant noise spatial covariance matrix $\hat{R}_{k,f}$ (the third noise spatial covariance matrix) is generated on the basis of the time-variant noise spatial covariance matrix (the second noise spatial covariance matrix) corresponding to the time-frequency-divided observation signals $x_{t,f}$ and the mask information $\lambda_{t,f}^{(j)}$ belonging to each short time interval $B_k$ (where $k \in \{1, \ldots, K\}$) and each frequency band f with respect to noise formed by adding together all of the noise sources, and the weighted sum of the noise spatial covariance matrices $\psi_f^{(j)}$ (the first noise spatial covariance matrices) with the mixture weights $\mu_{k,f}^{(j)}$ of the respective short time intervals $B_k$. Here, the noise spatial covariance matrix $\psi_f^{(j)}$ is calculated using all of the time-frequency-divided observation signals $x_{t,f}$ and the mask information $\lambda_{t,f}^{(j)}$ belonging to the long time interval L (step S11), and therefore a high degree of estimation precision can be secured for the noise spatial covariance matrix $\psi_f^{(j)}$. Meanwhile, the time-variant noise spatial covariance matrix $\hat{R}_{k,f}$, which is based on the time-variant noise spatial covariance matrix corresponding to the time-frequency-divided observation signals $x_{t,f}$ and the mask information $\lambda_{t,f}^{(j)}$ belonging to each short time interval $B_k$ with respect to noise formed by adding together all of the noise sources and the weighted sum of the noise spatial covariance matrices $\psi_f^{(j)}$ with to the mixture weights $\mu_{k,f}^{(j)}$ of the respective short time intervals $B_k$ is acquired for the short time intervals $B_1, \ldots, B_K$, and therefore the acquired noise spatial covariance matrix $\hat{R}_{k,f}$ responds flexibly to temporal variation over the short time intervals $B_k$. According to this embodiment, therefore, a highly precise noise spatial covariance matrix that responds flexibly to temporal variation in the time-frequency-divided observation signals $x_{t,f}$ can be acquired.

Second Embodiment

Next, a second embodiment will be described. The second embodiment differs from the first embodiment in that the weights of the first noise spatial covariance matrix and the second noise spatial covariance matrix in the third noise spatial covariance matrix can be modified on the basis of the input parameter. The following description focuses on differences with the matter already described, and with respect to the matter already described, identical reference numerals will be used and the description will be simplified.

As shown in FIG. 1, the noise spatial covariance matrix estimation device 10 according to this embodiment includes noise spatial covariance matrix calculation units 21, 23 and a mixture weight calculation unit 12. The noise spatial covariance matrix calculation units 11, 13 according to the first embodiment perform the calculations of formulae (1) and (3) using the predetermined parameter $v_f^{(j)}$, for example. The noise spatial covariance matrix calculation units 21, 23 according to the second embodiment, on the other hand, receive input of the parameter $v_f^{(j)}$ and perform the calculations of formulae (1) and (3) using the input parameter $v_f^{(j)}$, for example. As a result, the weights of the noise spatial covariance matrix $\psi_f^{(j)}$ and the noise spatial covariance matrix $$\sum_{t \in B_k} \sum_{j \in \{1,\cdots,J\}} \lambda_{t,f}^{(j)} x_{t,f} x_{t,f}^{H}$$

in the noise spatial covariance matrix $\hat{R}_{k,f}$ can be adjusted. More specifically, as the value of the parameter $v_f^{(j)}$ is increased, the weight of the noise spatial covariance matrix $\psi_f^{(j)}$ increases, leading to an improvement in the estimation precision in exchange for a reduction in the responsiveness to temporal variation in the time-frequency-divided observation signals $x_{t,f}$. Conversely, as the value of the parameter $\nu_f^{(j)}$ is reduced, the weight of the noise spatial covariance matrix $$\sum_{t\in B_k}\sum_{j\in\{1,\cdots,J\}}\lambda_{t,f}^{(j)}x_{t,f}x_{t,f}^H$$

increases, leading to an improvement in the responsiveness to temporal variation in the time-frequency-divided observation signals $x_{t,f}$ in exchange for estimation stability. Otherwise, the second embodiment is as described in the first embodiment.

Third Embodiment

Next, a third embodiment will be described. The third embodiment is an example application of the first and second embodiments, in which the noise spatial covariance matrix $\hat{R}_{k,f}$ generated as described in the first and second embodiments is used in noise suppression processing. The configuration and processing content of a noise suppression device 30 according to the third embodiment will be described below with reference to FIGS. 3A and 3B.

Figure 3A:
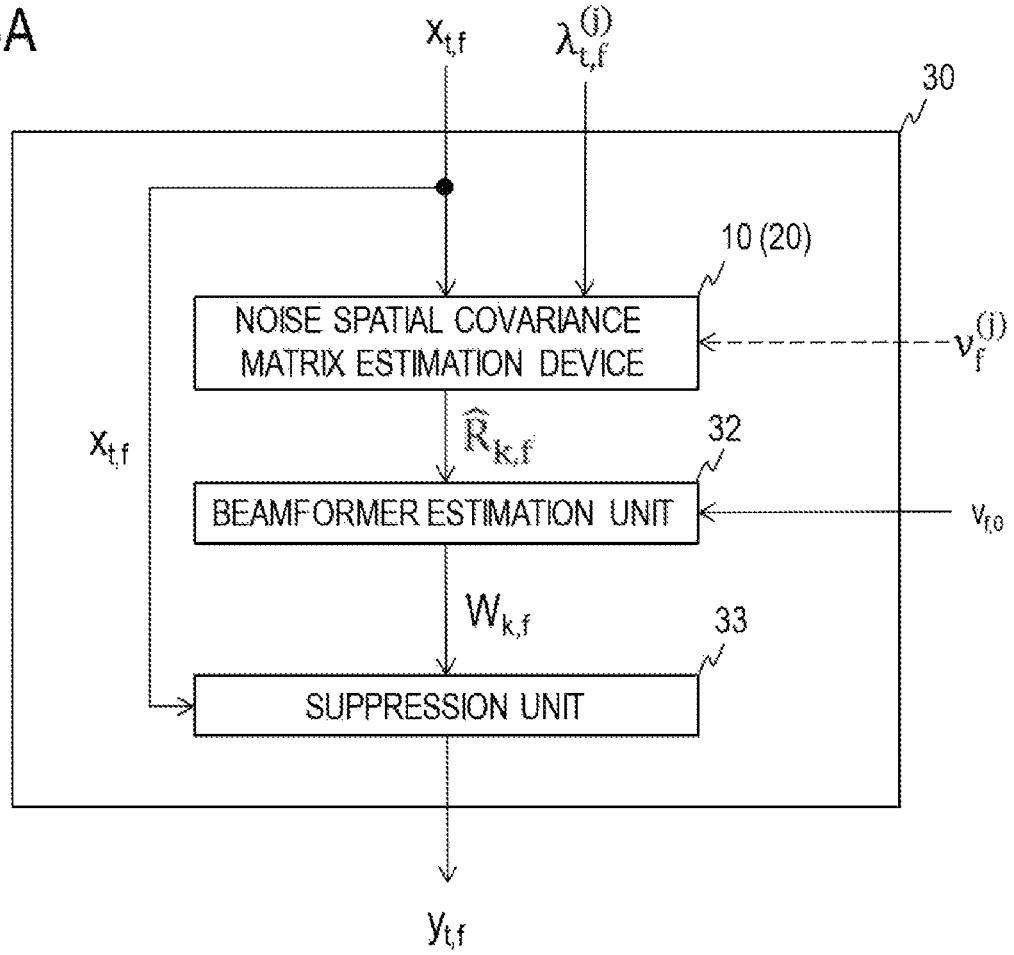
FIG. 3A is a block diagram showing an example of a functional configuration of a noise removal device using the noise spatial covariance matrix estimation device according to this embodiment.
Figure 3B:
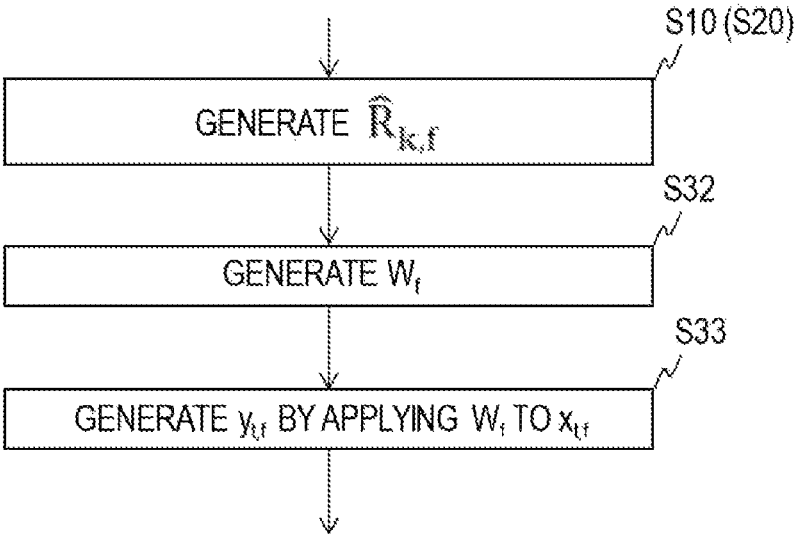
FIG. 3B is a flowchart showing an example of a noise removal method using the noise spatial covariance matrix estimation method according to this embodiment.

As shown in FIG. 3A, the noise suppression device 30 according to the third embodiment includes the noise spatial covariance matrix estimation device 10 or 20, a beamformer estimation unit 32, and a suppression unit 33.

As described in the first or second embodiment, the noise spatial covariance matrix estimation device 10 or 20 generates and outputs the noise spatial covariance matrix $\hat{R}_{k,f}$ using the time-frequency-divided observation signals $x_{t,f}$ and the mask information $\lambda_{t,f}^{(j)}$ and if necessary, also the parameter $\nu_f^{(j)}$) as input (step S10 (step S20)). The noise spatial covariance matrix $\hat{R}_{k,f}$ is transmitted to the beamformer estimation unit 32.

The beamformer estimation unit 32 generates and outputs a beamformer (an instantaneous beamformer) $W_{k,f}$ for each short time interval $B_k$ using as input the noise spatial covariance matrix $\hat{R}_{k,f}$ and a steering vector $\nu_{f,0}$ corresponding to the sound source to be subjected to estimation using the beamformer (step S32). Methods for generating the steering vector $\nu_{f,0}$ and the beamformer (the instantaneous beamformer) $W_{k,f}$ are well-known, and are described in reference documents 4 and 5, and so on, for example.

Reference document 4: T Higuchi, N Ito, T Yoshioka, and T Nakatani, "Robust MVDR beamforming using time-frequency masks for online/offline ASR in noise", Proc. ICASSP 2016, 2016.

Reference document 5: J Heymann, L Drude, and R Haeb-Umbach, "Neural network based spectral mask estimation for acoustic beamforming", Proc. ICASSP 2016, 2016.

The beamformer $W_{k,f}$ is transmitted to the suppression unit 33.

The suppression unit 33, using the time-frequency-divided observation signals $x_{t,f}$ and the beamformer $W_{k,f}$ as input, applies the beamformer $W_{k,f}$ to the time-frequency-divided observation signals $x_{t,f}$ as shown below in formula (4) in order to acquire time-frequency-divided observation signals $y_{t,f}$ in which noise has been suppressed from the time-frequency-divided observation signals $x_{t,f}$. The suppression unit 33 then outputs the time-frequency-divided observation signals $y_{t,f}$.

$$y_{t,f}=W_{k,f}x_{t,f} \tag{4}$$

The time-frequency-divided observation signals $y_{t,f}$ may be used in other processing in the frequency domain or may be converted into the time domain. When the time-frequency-divided observation signals $y_{t,f}$ acquired as described above are used in voice recognition processing, for example, a word error rate can be improved by approximately 20% in comparison with a case where signals acquired by estimating a beamformer using the non-time-variant noise spatial covariance matrix estimation method illustrated in NPL 1 and suppressing noise therein are used in voice recognition processing.

Other Modified Examples and so on

Note that the present invention is not limited to the embodiments described above. For example, in the above embodiments, the long time interval L is not updated, but the time-variant noise spatial covariance matrix $\hat{R}_{k,f}$ may be acquired for each short time interval in the manner described above while updating the long time interval L. For example, the noise spatial covariance matrix $\hat{R}_{k,f}$ may be acquired in the manner described above by batch processing, or the noise spatial covariance matrix $\hat{R}_{k,f}$ may be acquired in the manner described above by sequentially extracting data of a length corresponding to the long time interval L from time-frequency-divided observation signals $x_{t,f}$ and mask information $\lambda_{t,f}^{(j)}$ input into the noise spatial covariance matrix estimation device in real time.

Instead of formula (1), the noise spatial covariance matrix $\psi_f^{(j)}$ may be calculated as follows.

$$\Psi_f^{(j)}=\beta\sum_{t\in L}\lambda_{t,f}^{(j)}x_{t,f}x_{t,f}^H$$

Here, β is a coefficient and may be either a constant or a variable.

Further, instead of formula (3), the noise spatial covariance matrix $\hat{R}_{k,f}$ may be calculated as follows.

$$\hat{R}_{k,f}=\frac{\sum_{t\in B_k}\sum_{j\in\{1,\cdots,J\}}\lambda_{t,f}^{(j)}x_{t,f}x_{t,f}^H+\sum_{j\in\{1,\ldots,J\}}\mu_{k,f}^{(j)}\Psi_f^{(j)}}{\theta}$$

Here, θ is a coefficient and may be either a constant or a variable.

Further, in the third embodiment, the noise spatial covariance matrix $\hat{R}_{k,f}$ is used in noise suppression processing, but the noise spatial covariance matrix $\hat{R}_{k,f}$ may be used in another application such as sound source position (sound source direction) estimation.

The various processing described above does not have to be executed in time series in accordance with the description and may, depending on the processing capacity of the devices that execute the processing or as required, be executed in parallel or individually. The processing may also be modified as appropriate within a scope that does not depart from the spirit of the present invention.

The devices described above are configured by having a general-purpose or dedicated computer including a processor (a hardware processor) such as a CPU (central processing unit) and a memory such as a RAM (random-access memory) or a ROM (read-only memory) execute a predetermined program, for example. The computer may include one processor and one memory or pluralities of processors and memories. The program may be installed in the computer or recorded in advance in the ROM or the like. Further, some or all of the processing units may be configured using electronic circuitry that realizes processing functions without using a program rather than electronic circuitry that realizes processing functions by reading a program, such as a CPU. Electronic circuitry constituting a single device may include a plurality of CPUs.

When the configurations described above are realized by a computer, the processing content of the functions to be provided in the devices is described by a program. By having the computer execute the program, the processing functions described above are realized on the computer. The program describing the processing content can be recorded on a computer-readable recording medium. An example of a computer-readable recording medium is a non-transitory recording medium. Examples of this type of recording medium include a magnetic recording device, an optical disk, a magneto-optical recording medium, a semiconductor memory, and so on.

The program is distributed by selling, transferring, lending, or otherwise distributing a portable recording medium such as a DVD or a CD-ROM on which the program is recorded, for example. The program may also be distributed by storing the program in a storage device of a server computer and transferring the program from the server computer to another computer over a network.

For example, the computer that executes the program first temporarily stores the program, which has been recorded on a portable recording medium or transferred from a server computer, in a storage device provided therein. Then, when the processing is to be executed, the computer reads the program stored in the storage device and executes processing corresponding to the read program. Further, as another embodiment of the program, the computer may read the program directly from the portable recording medium and execute processing corresponding to the program. Furthermore, the computer may execute processing corresponding to the received program successively each time the program is transferred thereto from the server computer. Alternatively, the processing described above may be executed using a so-called ASP (Application Service Provider) service in which, instead of transferring the program from the server computer to the computer, the processing functions are realized only by issuing execution commands and acquiring results.

Instead of realizing the processing functions of the present device by executing a predetermined program on a computer, at least some of the processing functions may be realized by hardware.

REFERENCE SIGNS LIST

10, 20 Noise spatial covariance matrix estimation device

The invention claimed is:

1. A noise spatial covariance matrix estimation device comprising processing circuitry configured to:

use time-frequency-divided observation signals $x_{t,f}$ and mask information $\lambda_{t,f}^{(j)}$ to acquire, for each noise source j, time-independent first noise spatial covariance matrices $\psi_f^{(j)}$ corresponding to the time-frequency-divided observation signals $x_{t,f}$ and the mask information $\lambda_{t,f}^{(j)}$ for all $t \in L$, wherein j is a positive integer expressing a noise source number, J is a positive integer expressing a number of the noise sources, $j=1, \ldots, J$ holds, t is a positive integer expressing a time frame number, f is a positive integer expressing a frequency band number, L is a long time interval, the time-frequency-divided observation signals $x_{t,f}$ are based on observation signals acquired using one or more microphones by collecting acoustic signals emitted from one or a plurality of sound sources, and the mask information $\lambda_{t,f}^{(j)}$ expresses an occupancy probability of a component corresponding to each noise source j in each of the time-frequency-divided observation signals $X_{t,f}$;

use the mask information $\lambda_{t,f}^{(j)}$ for $t \in B_k$ of each of a plurality of different short time intervals $B_1, \ldots, B_K$ to acquire a mixture weight $\mu_{k,f}^{(j)}$ corresponding to each noise source j in each short time interval $B_k$, wherein K is an integer greater than 1, $k=1, \ldots, K$, each short time interval $B_k$ is shorter than the long time interval L, and each short time interval $B_k$ is a part of L; and acquire and output a time-variant third noise spatial covariance matrix $\hat{R}_{k,f}$ for a noise of the acoustic signals based on a time-variant second noise spatial covariance matrix and a weighted sum of the first noise spatial covariance matrices $\psi_f^{(j)}$ with the mixture weights $\mu_{k,f}^{(j)}$ for each short time interval $B_k$, wherein the second noise spatial covariance matrix corresponds to the time-frequency-divided observation signals $x_{t,f}$ and the mask information $\lambda_{t,f}^{(j)}$ for the noise source j and $t \in B_k$ of each short time interval $B_k$, and the noise is formed by all of the noise sources $j=1, \ldots, J$.

2. The noise spatial covariance matrix estimation device according to claim 1, wherein the third noise spatial covariance matrix $\hat{R}_{k,f}$ is a weighted sum of the second noise spatial covariance matrix and the weighted sum of the first noise spatial covariance matrices $\psi_f^{(j)}$ with the mixture weights $\mu_{k,f}^{(j)}$ of each short time interval $B_k$, and respective weights of the first noise spatial covariance matrices $\psi_f^{(j)}$ and the second noise spatial covariance matrix in the third noise spatial covariance matrix $\hat{R}_{k,f}$ is modifiable.

3. The noise spatial covariance matrix estimation device according to claim 1, wherein $\alpha^T$ represents a non-conjugate transpose of $\alpha$ and $\alpha^H$ represents a conjugate transpose of a, J noise sources exist, J being an integer of 1 or more, the observation signals are collected by I microphones, I being an integer of 2 or more, the time-frequency-divided observation signals that correspond to a frequency band f at a time frame t and correspond to the observation signals acquired by collecting sound in an $i^{th}$ microphone, are $x_{t,f,i}$ where $x_{t,f}=(x_{t,f,1}, \ldots, x_{t,f,I})^T$, the mask information expressing the occupancy probability of the component that corresponds to a $j^{th}$ noise source in each of the time-frequency-divided observation signals $x_{t,f,1}, \ldots, x_{t,f,I}$ in the frequency band f at the time frame t is $\lambda_{t,f}^{(j)}$, each of the first noise spatial covariance matrices corresponding to the $j^{th}$ noise source is $\psi_f^{(j)}$, $\psi_f^{(j)}$ being a sum or a weighted sum of $\lambda_{t,f}^{(j)} \times x_{t,f} \times x_{t,f}^H$ with respect to the frequency band f at the time frame f belonging to the long time interval, with regard to the short time intervals $B_1, \ldots, B_K$, K is an integer of 2 or more, and $k=1, \ldots, K$, each of the mixture weights $\mu_{k,f}^{(j)}$ corresponding to the frequency band f at each of the short time intervals $B_k$ with respect to each of the noise sources $j \in \{1, \ldots, J\}$ is each a ratio of the sum of the mask information $\lambda_{t,f}^{(j)}$ corresponding to the frequency band f at the time frame t belonging to the respective short time intervals $B_k$ with respect to each noise source j to the sum of the mask information $\lambda_{t,f}^{(j)}$ corresponding to the frequency band f at the time frame t belonging to the respective short time intervals $B_k$ with respect to all of the noise sources $j' \in \{1, \ldots, J\}$, the second noise spatial covariance matrix that corresponds to the time-frequency-divided observation signals $X_{t,f}$ and the mask information $\lambda_{t,f}^{(j)}$ belonging to each short time interval $B_k$ and each frequency band f and relates to noise formed by adding together all of the noise sources is the sum or the weighted sum of $\lambda_{t,f}^{(j)} \times x_{t,f} \times x_{t,f}^{H}$ at the time frames t and all of the noise sources j belonging to each short time interval $B_k$ and each frequency f, and the third noise spatial covariance matrix is based on a weighted sum of the second noise spatial covariance matrix and a weighted sum of the first noise spatial covariance matrices $\psi_f^{(j)}$ with the mixture weights $\mu_{k,f}^{(j)}$ for all of the noise sources j.

4. A noise spatial covariance matrix estimation method comprising:

using time-frequency-divided observation signals $X_{t,f}$ and mask information $\lambda_{t,f}^{(j)}$ to acquire, for each noise source j, time-independent first noise spatial covariance matrices $\psi_f^{(j)}$ corresponding to the time-frequency-divided observation signals $x_{t,f}$ and the mask information $\lambda_{t,f}^{(j)}$ for all $t \in L$, wherein j is a positive integer expressing a noise source number, J is a positive integer expressing a number of the noise sources, $j=1, \ldots, J$ holds, t is a positive integer expressing a time frame number, f is a positive integer expressing a frequency band number, L is a long time interval, the time-frequency-divided observation signals $x_{t,f}$ are based on observation signals acquired using one or more microphones by collecting acoustic signals emitted from one or a plurality of sound sources, and the mask information $\lambda_{t,f}^{(j)}$ expresses an occupancy probability of a component corresponding to each noise source j in each of the time-frequency-divided observation signals $x_{t,f}$, using the mask information $\lambda_{t,f}^{(j)}$ for $t \in B_k$ of each of a plurality of different short time intervals $B_1, \ldots, B_K$ to acquire mixture weight $\mu_{k,f}^{(j)}$ corresponding to each noise source j in each short time interval $B_K$, wherein K is an integer greater than 1, $k=1, \ldots, K$, and each short time interval $B_k$ is shorter than the long time interval L, and each short time interval $B_k$ is a part of L; and acquiring and outputting a time-variant third noise spatial covariance matrix $\hat{R}_{k,f}$ for a noise of the acoustic signals based on a time-variant second noise spatial covariance matrix and a weighted sum of the first noise spatial covariance matrices $\psi_f^{(j)}$ with the mixture weights $\mu_{k,f}^{(j)}$ for each short time interval $B_k$, wherein the second noise spatial covariance matrix corresponds to the time-frequency-divided observation signals $x_{t,f}$ and the mask information $\lambda_{t,f}^{(j)}$ for the noise source j and $t \in B_k$ of each short time interval $B_k$, where the noise is formed by all of the noise sources $j=1, \ldots, J$.

5. A non-transitory computer-readable recording medium storing a program for causing a program for casing a computer to function as the noise spatial covariance matrix estimation device according to claim 1.

* * * * *